US007430299B2

(12) United States Patent
Armstrong et al.

(10) Patent No.: US 7,430,299 B2
(45) Date of Patent: Sep. 30, 2008

(54) SYSTEM AND METHOD FOR TRANSMITTING AUDIO VIA A SERIAL DATA PORT IN A HEARING INSTRUMENT

(75) Inventors: Stephen W. Armstrong, Burlington (CA); Brian D. Csermak, Dundas (CA)

(73) Assignee: Sound Design Technologies, Ltd., Burlington, Ontario (CA)

( * ) Notice: Subject to any disclaimer, the term of this patent is extended or adjusted under 35 U.S.C. 154(b) by 626 days.

(21) Appl. No.: 10/822,519

(22) Filed: Apr. 12, 2004

(65) Prior Publication Data

US 2004/0202340 A1 Oct. 14, 2004

Related U.S. Application Data

(60) Provisional application No. 60/461,943, filed on Apr. 10, 2003.

(51) Int. Cl.
*H04R 25/00* (2006.01)
*H04R 29/00* (2006.01)

(52) U.S. Cl. ..... 381/312; 381/314; 381/60

(58) Field of Classification Search ..... 381/312, 381/314, 60, 23.1

See application file for complete search history.

(56) References Cited

U.S. PATENT DOCUMENTS 6,115,478 A * 9/2000 Schneider ..... 381/314
6,144,748 A * 11/2000 Kerns ..... 381/312
6,366,863 B1 4/2002 Bye et al.

(Continued)

FOREIGN PATENT DOCUMENTS

DE 4128172 3/1993

(Continued)

OTHER PUBLICATIONS

The European Search Report for EP application 04008778.5 which is the European counterpart to the present application.

(Continued)

*Primary Examiner*—Suhan Ni
*Assistant Examiner*—Tuan D Nguyen
(74) *Attorney, Agent, or Firm*—Van Dyke, Gardner, Linn & Burkhart, LLP

(57) ABSTRACT

In accordance with the teachings described herein, systems and methods are provided for transmitting audio via the serial data port of a hearing instrument. At least one hearing instrument microphone may be used for receiving an audio input signal. A sound processor may be used for processing the audio input signal to compensate for a hearing impairment and generate a processed audio signal. At least one hearing instrument receiver may be used for converting the processed audio signal into an audio output signal. A serial data port may be used to couple the hearing instrument to an external device in order to transmit bi-directional audio signals between the hearing instrument and the external device. The serial data port may be coupled to the external device to transmit at least one of the audio input signal, the processed audio signal and the audio output signal to the external device. In addition, a selection circuitry may be used to select at least one of the audio input signal, the processed audio signal and the audio output signal for transmission to the external device via the serial data port.

11 Claims, 5 Drawing Sheets

U.S. PATENT DOCUMENTS

| | | | | |
|---|---|---|---|---|
| 6,590,986 | B1 * | 7/2003 | Fazio | 381/314 |
| 2003/0007647 | A1 | 1/2003 | Nielson et al. | |

FOREIGN PATENT DOCUMENTS

| | | |
|---|---|---|
| WO | WO 9931936 | 6/1999 |

OTHER PUBLICATIONS

Claims for EP application 04008778.5, which are the subject of the Nov. 12, 2007 search report from the European Patent Office filed concurrently herewith.

Translation of DE 4128172 A1 as generated by the automated translation service of the European Patent Office's website.

* cited by examiner

SYSTEM AND METHOD FOR TRANSMITTING AUDIO VIA A SERIAL DATA PORT IN A HEARING INSTRUMENT

CROSS-REFERENCE TO RELATED APPLICATION

This application claims priority from and is related to the following prior application: "System and Method for Transmitting Audio via a Serial Data Port in a Hearing Instrument," U.S. Provisional Application No. 60/461,943, filed Apr. 10, 2003. The entirety of this is prior application is hereby incorporated into the present application by reference.

FIELD

The technology described in this patent document relates generally to the field of hearing instruments. More particularly, the patent document describes a system and method for transmitting audio via a serial data port in a hearing instrument.

BACKGROUND

Audiologists typically rely on feedback from a hearing aid wearer to determine the quality of the audio signal being passed to the wearer's ear canal as well as to determine the effect of her adjustments and the appropriateness of the device for the patient. As the audiologist changes various fitting parameters, such as gain or compression thresholds, the audiologist will typically rely on the hearing aid wearer to provide feedback such as "that's better" or "that sounds worse," etc. This customary approach can be particularly problematic when the hearing aid wearer is cognitively impaired or unable to express himself adequately for a variety of reasons including lack of experience with hearing instruments. Consequently, the audiologist typically has no first hand information to accurately determine the results of the adjustments that she is making to the hearing instrument.

One known method for monitoring hearing instrument performance is the use of a probe microphone, which may be inserted into the ear canal through the hearing aid vent. Probe microphones are typically used to verify hearing instrument parameters, such as real ear insertion gain (REIG). However, probe microphone methods are not widely used for a number of reasons, including the amount of effort involved, potential patient discomfort and risk, and the resultant changes to the acoustic field in the ear canal caused by insertion of the microphone.

SUMMARY

In accordance with the teachings described herein, systems and methods are provided for transmitting audio via the serial data port of a hearing instrument. At least one hearing instrument microphone may be used for receiving an audio input signal. A sound processor may be used for processing the audio input signal to compensate for a hearing impairment and generate a processed audio signal. At least one hearing instrument receiver may be used for converting the processed audio signal into an audio output signal. A serial data port may be used to couple the hearing instrument to an external device in order to transmit bi-directional audio signals between the hearing instrument and the external device. The serial data port may be coupled to the external device to transmit at least one of the audio input signal, the processed audio signal and the audio output signal to the external device. In addition, a selection circuitry may be used to select at least one of the audio input signal, the processed audio signal and the audio output signal for transmission to the external device via the serial data port.

DETAILED DESCRIPTION

The technology described in this patent document utilizes a serial data (SDA) port on a hearing instrument to pass audio data between the hearing instrument and an external device, such as a computer. For example, the SDA port may be used to capture measurement data from the hearing instrument microphones and to send test stimulus to the hearing instrument receiver (i.e., the loudspeaker.) The SDA interface could be either wired or wireless. This technology is particularly well-suited for use in a digital hearing instrument that includes a programming interface having an SDA port. For the purposes of this patent document, the term "hearing instrument" may include any personal listening device, such as a hearing aid, wireless cell phone earpiece, etc.

Figure 1:
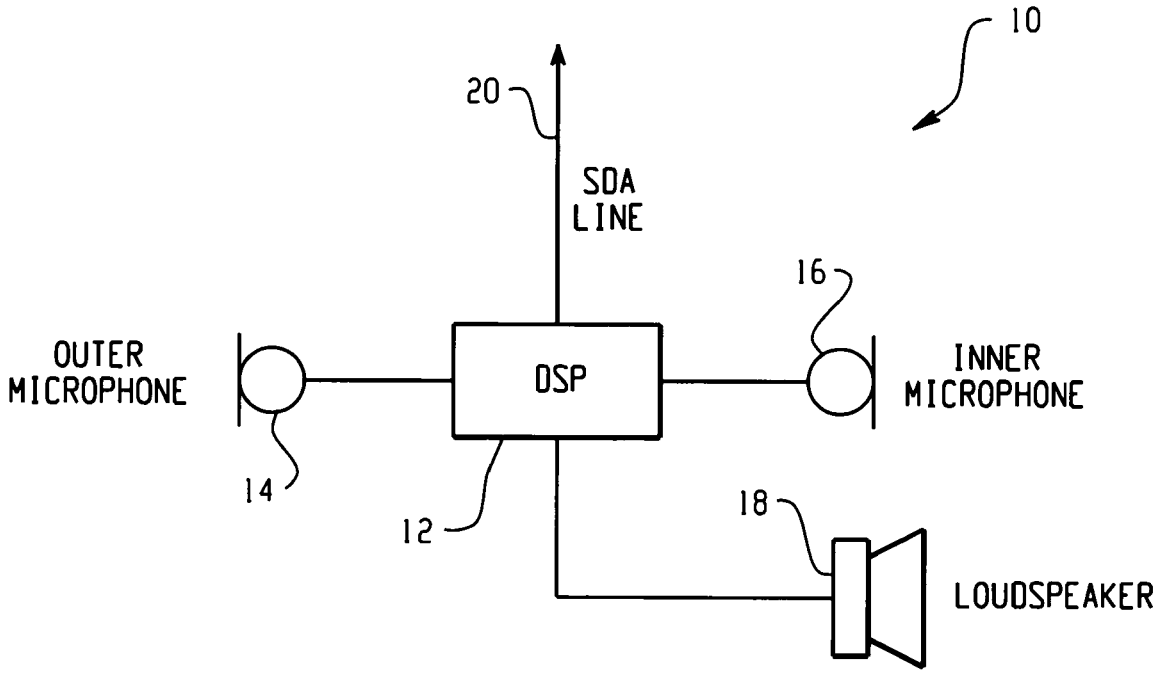
FIG. 1 is a block diagram illustrating an example hearing instrument having a serial data audio (SDA) port and an ear canal microphone.

With reference now to the drawing figures, FIG. 1 is a block diagram illustrating an example hearing instrument 10 having a serial data (SDA) port 20 and an ear canal microphone 16. The hearing instrument 10 includes a digital signal processor (DSP) 12 for controlling the operation of the hearing instrument 10, an outer microphone 14 for receiving audio signals from outside of the ear canal; the ear canal microphone 16 for receiving audio signal from inside of the ear canal; and a loudspeaker 18 (also referred to as a receiver) for transmitting audio signals into the ear canal. In addition, the hearing instrument 10 includes the SDA port 20, which is operable to transmit serial data, such as an audio signal, to and from the DSP 12. It should be understood that FIG. 1 provides a simplified diagram of a hearing instrument for the purposes of illustrating the function of transmitting information over the SDA port 20. A more detailed description of an example hearing instrument is provided below with reference to FIGS. 4A and 4B.

In operation, audio data received by the microphones 14, 16 (or being delivered to the loudspeaker) is routed into the digital signal processor 12 (DSP) where it can be formatted for transmission (wired or wireless) via the SDA port 20. For example, audio data may be transmitted to an external device, such as a dedicated programming box, and then routed onto a PC where it can be auditioned by the audiologist via the PC's sound card and a set of speakers/headphones. In another example, a programming box could include audio equipment operable to allow the audiologist to listen to the audio directly without the aid of a PC. It should be understood, however, that audio can be routed out through the SDA line to many different types of external devices and the transmission protocol may vary.

In one example, an audiologist can listen to the audio in the hearing aid wearer's ear canal by streaming the audio data from the inner (ear canal) microphone out through the SDA line (after formatting and conditioning by the DSP). In this manner, the audiologist may listen in real time to the quality of the sound being delivered to the ear canal and may verify the effect of adjusting the various hearing aid parameters (such as gain, compression thresholds, tone controls, etc.).

In another example, audio transmitted via the SDA port 20 may be recorded (e.g., on a PC or other recording device) for comparison against recordings under different hearing aid configurations or even between different hearing aids. In this manner, the recording may be used as a quality check or way of keeping track of the functionality of a given hearing aid over time. For example, if a patient returns at a later date with a complaint, the audiologist can make a new recording of the audio in the patient's ear canal and compare it with a previous one to determine if there has been some change in the operation or sound quality of the hearing aid. These recordings (or live feeds of the audio data) may, for example, be sent to the manufacturer to help the audiologist troubleshoot malfunctioning units or to allow the manufacturer's customer support to aid in the adjustment of the hearing aid in difficult fittings. In one embodiment, the recording may also be used as a means to provide product training to the audiologist remotely by the manufacturer.

In another example, the inner microphone may be used to capture otoacoustic emissions, and to route the captured emissions through the SDA line to a PC for analysis as part of a hearing and ear-health assessment.

Audio data may also be fed into the hearing aid to drive the loudspeaker or for other purposes. Possible examples include test signals to assess hearing loss (which might include the generation of Tartini tones), verbal instructions by an audiologist, or music.

Using the SDA port 20, an audiologist may listen directly to the audio in a patient's ear canal to determine the sound quality of the hearing aid as well as the effect of hearing aid parameter adjustments made by the audiologist. This allows the audiologist to verify directly, without relying on patient feedback, the impact of her adjustments. This is often desirable because patient feedback can be unreliable or not descriptive enough to provide the audiologist with confidence that she has fit the hearing aid optimally.

In addition, by routing audio data from the hearing aid through the SDA port 20, the audiologist can record the audio (via PC for example) and use the recording in a variety of ways. For example, among other possible uses, such recording could be used to: a) make a comparison of recordings between different hearing aid configurations or between different hearing aids; b) provide an indication to prospective customers what type of sound quality they can expect from such a hearing aid; c) provide a means to track and compare the sound delivered by a hearing aid over time which could be used to address customer complaints or to troubleshoot malfunctions; d) provide to the manufacturer as proof of malfunction or sub optimal quality for return for credit or to assist in fitting the hearing aid to meet a patient's specific needs (this could also be done via a live feed); e) deliver a live feed of the audio via the internet and allow an audiologist or manufacturer to assist in the fitting or assessment of the hearing aid remotely; f) allow an audiologist to monitor sound in a patient's ear canal which enables him to better assess hearing aid's performance and more effectively configure the device; g) allow for monitoring or capture of signals captured/produced at electrical outputs/inputs of transducers, which could be used to troubleshoot device and isolate transducer malfunctions; h) allow recordings to be made of the sounds to be used for marketing/illustration of hearing aid's performance, as proof of malfunction for return for credit, or for comparison with other hearing aids or previous recordings of the same hearing aid; i) enable audiologist to listen to and capture otoacoustic emissions; j) feed live audio data from the hearing aid to a remote person; and k) feed audio data into the aid and out through the loudspeaker (as a test stimulus or even for the purpose of entertainment).

Figure 2:
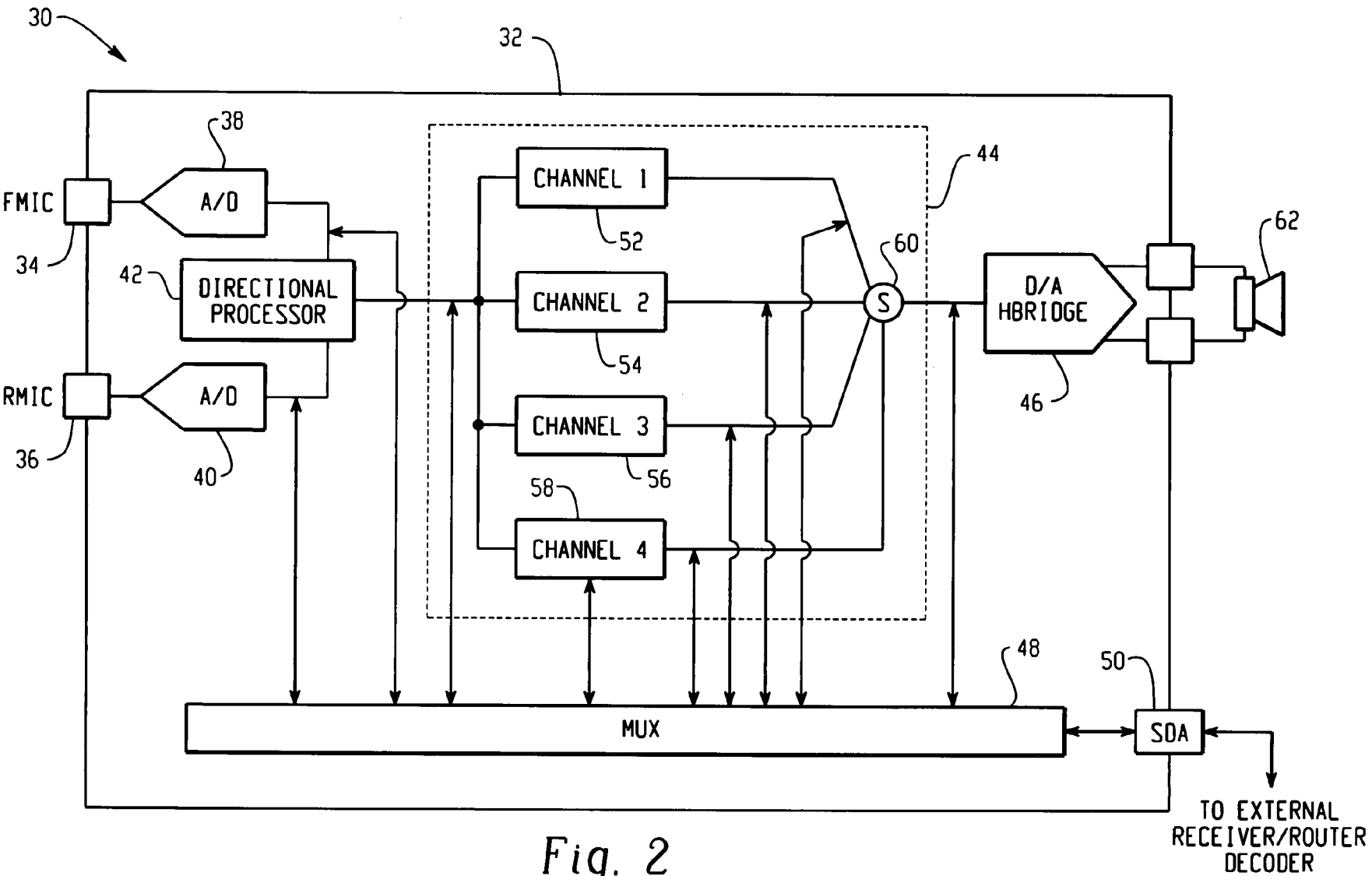
FIG. 2 is a more-detailed block diagram of an example system for transmitting audio via a serial data port (SDA) in a hearing instrument.

FIG. 2 is a more-detailed block diagram of an example system for transmitting audio via a serial data port (SDA) in a hearing instrument 32. The example hearing instrument 32 includes front and rear microphones 34, 36 for receiving audio signals, a plurality of analog-to-digital converters 38, 40 for converting the received audio signals into digital audio signals, a directional processor 42 for generating a directionally-sensitive response from the audio signals received from the front and rear microphones 38, 40, and a sound processor 44 for processing the directional audio signal to compensate for hearing impairments. The example sound processor 44 includes a plurality of channel processors 52, 54, 56, 58 for correcting hearing impairments within specific frequency bands of the received audio signal and a summation circuit for combining the processed output of the channel processors 52, 54, 56, 58 into a single audio signal. The example hearing instrument 32 also includes a digital-to-analog (D/A) converter 46 for converting the processed audio signal into an analog output that may be directed into a user's ear canal by a hearing instrument speaker 62. In addition, the example hearing instrument 48 includes a selection circuitry 48 (e.g., a muliplexer) and a serial data port 50 for transmitting audio signals or other data between the hearing instrument 32 and an external device.

In operation, the selection circuitry 48 may be configured to receive audio signals from any one or more of a plurality of nodes within the hearing instrument, and selectively transmit one or more of the audio signals to an external device via the SDA 50. For example, the selection circuitry 48 may be configured to transmit audio signals received from the outputs of the A/D converters 38, 40, the output of the directional processor 42, the outputs of the channel processors 52, 54, 56, 58, the output of the sound processor 44, and/or other nodes within the hearing instrument 32. The selection circuitry 48 may, for instance, be configured by a hearing instrument user, an audiologist or by some other person or machine to select one or more of the audio signal inputs to the multiplexer 48 for transmission via the SDA 50 as a serial output. A control signal for configuring the selection circuitry 48 may be input to the multiplexer 48 from an external device via the SDA 50, or alternatively, the selection circuitry 48 may be programmed by some other means, such as a switch or other input device on the hearing instrument, a remote control device, or some other means for programming a digital hearing instrument.

In addition, the selection circuitry 48 may also be configured to inject audio signals or other data into any one or more of a plurality of nodes within the hearing instrument 32. For example, the selection circuitry 48 may be configured to inject an audio signal or other data received from an external device via the SDA 50 into one or more of the outputs of the A/D converters 38, 40, the output of the directional processor 42, the outputs of the channel processors 52, 54, 56, 58, the output of the sound processor 44, and/or other nodes within the hearing instrument 32.

In one embodiment, the selection circuitry 48 may be configured to inject an audio signal into a select node within the hearing instrument 32 and transmit the audio signal from a different node over the SDA 50. In this manner, an audiologist may inject an audio signal into a select node within the hearing instrument and monitor the response at a different hearing instrument node. For example, an audiologist may test the functionality of the sound processor 44 by injecting a tone or sequence of tones at the directional processor output and monitoring the response at the output of the sound processor 44.

The selection circuitry 48 in the illustrated embodiment includes a multiplexer. It should be understood, however, that the hearing instrument 32 may include more than one multiplexer 48 to monitor and/or inject audio signals at nodes within the hearing instrument. In addition, selection circuitry other than a multiplexer may be used to generate a serial output from audio signals or other data received from a plurality of hearing instrument nodes and/or to inject audio signals or other data into one or more of a plurality of hearing instrument nodes.

Figure 3:
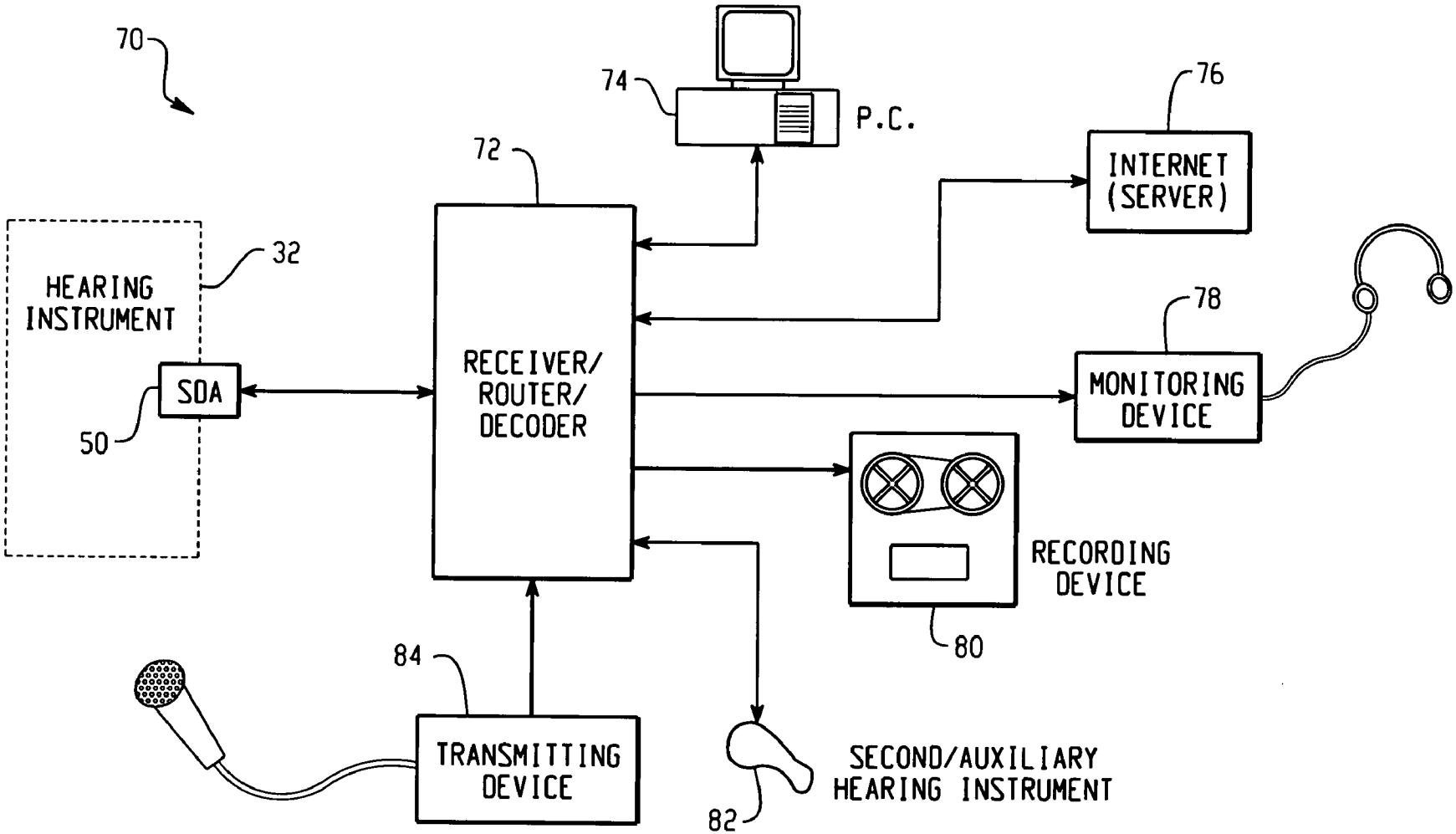
FIG. 3 is a block diagram illustrating example devices that may send and/or receive audio data and other information via the serial data port (SDA) in a hearing instrument.

FIG. 3 is a block diagram illustrating example devices 74, 76, 78, 80, 82, 84 that may send and/or receive audio data and other information via the serial data port (SDA) 50 in a hearing instrument 32. The illustrated devices include a computer 74, an computer network (e.g., an internet) 76, a monitoring device 78, a recording device 80, a second or auxiliary hearing instrument 82 and a transmitting device 84. Also illustrated is an interface device 72 for communicating audio signals and other data with the SDA port 50 of the hearing instrument 32 and routing the audio signals and other data to and from one or more of the external devices 74, 76, 78, 80, 82, 84. In addition, the interface device 72 may also perform other data processing functions, such as compression/decompression, coding/decoding, multiplexing/demultiplexing, serializing/deserializing, etc.

The computer 74 may, for example, be used by an audiologist to program the selection circuitry 48 in the hearing instrument 32, inject a tone or sequence of tones into select hearing instrument nodes, monitor the output of the hearing instrument at select hearing instrument nodes, and/or perform other diagnostic functions. The computer network 76 may, for example, be used to transmit audio signals or other data between the hearing instrument 32 and diagnostic equipment at a remote location. For instance, a hearing instrument user may be able to couple the SDA port 50 of the hearing instrument to a computer network 76 to allow an audiologist at a remote location to perform diagnostic tests on the hearing instrument.

The monitoring device 78 may, for example, be used by an audiologist or other person to listen to the output of the hearing instrument at select hearing instrument nodes. In this manner, an audiologist may effectively listen to what the hearing instrument user is hearing.

The recording device 80 may, for example, be used to record the output of the hearing instrument at select hearing instrument nodes. For instance, a hearing instrument user may attach the recording device to the SDA port 50 in order to capture a problematic audio output for later review by an audiologist. Other example uses of the recording device 80 may include providing a means for comparing recordings of different hearing instrument configurations or different hearing instruments, providing an indication to prospective customers of the sound quality provided by a hearing instrument, providing a means to track and compare the sound delivered by a hearing aid over time, and providing proof of a malfunction or sub optimal quality.

The second or auxiliary hearing instrument 82 may be coupled to the SDA port 50 in order to transmit audio signals or other data between two hearing instruments. For example, the SDA ports 50 of two hearing instruments (left ear and right ear) may be linked together to enable binaural applications. By routing control signals and/or audio signals between two hearing instruments, more advanced binaural algorithms may be utilized. For instance, sharing the audio signals received by the microphones in both hearing instruments may enable the use of more advanced directional processing algorithms and other more-advanced signal processing applications. In another example, the second or auxiliary hearing instrument 82 may be used for communication between two hearing instrument users.

The transmitting device 84 may, for example, be used to inject audio signals into select hearing instrument nodes. For instance, an audiologist may use the transmitting device 84 to inject spoken or recorded audio into one or more selected hearing instrument node in order to diagnose a hearing instrument malfunction, calibrate the hearing instrument, or for other purposes. In another example, the transmitting device 84 may be coupled to the SDA port 50 by a hearing instrument user for recreational purposes, such as streaming music or other recorded audio directly into the hearing instrument 32.

It should be understood that the illustrated external devices 74, 76, 78, 80, 82, 84 may be coupled to the SDA port 50 of a hearing instrument 32 for other diagnostic or non-diagnostic purposes. In addition, external devices other than those illustrated in FIG. 3 may also be used with the SDA port 50.

Figure 4A:
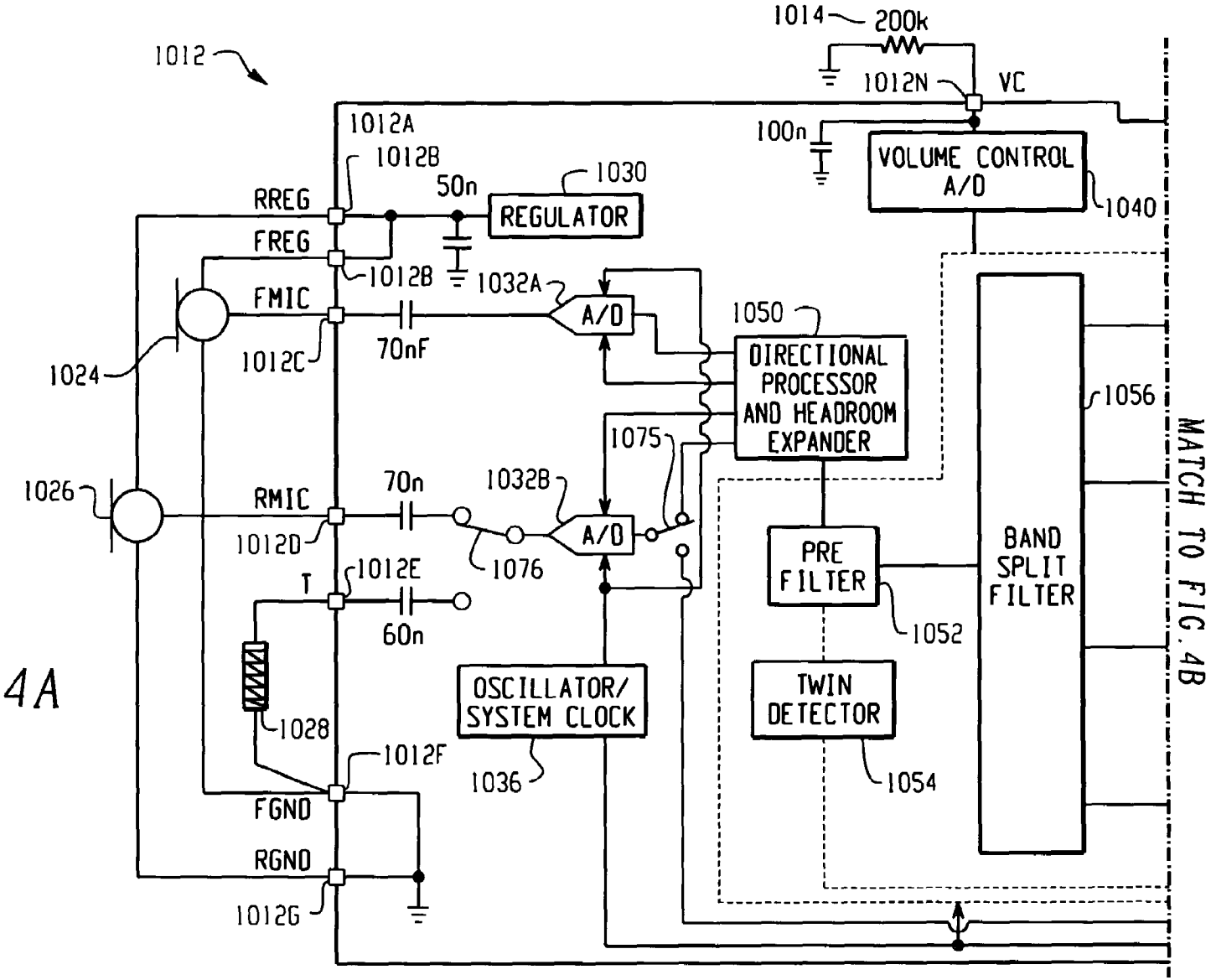
FIGS. 4A and 4B are a block diagram of an example digital hearing aid system that may incorporate a system for transmitting audio via a serial data port (SDA) in a hearing instrument.
Figure 4B:
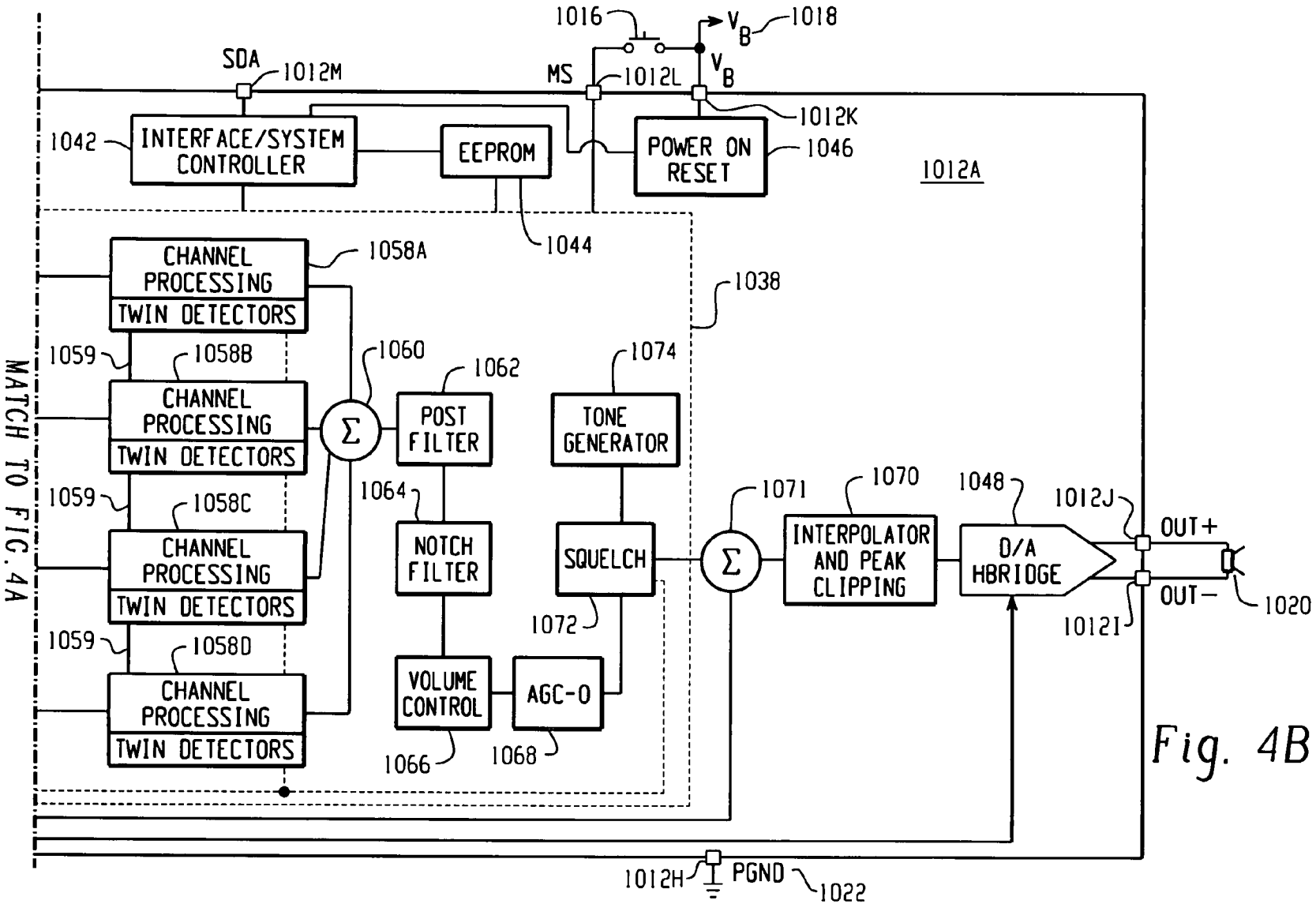

FIGS. 4A and 4B are a block diagram of an example digital hearing aid system 1012 that may incorporate a system for transmitting audio via a serial data port (SDA) in a hearing instrument, as described herein. The digital hearing aid system 1012 includes several external components 1014, 1016, 1018, 1020, 1022, 1024, 1026, 1028, and, preferably, a single integrated circuit (IC) 1012A. The external components include a pair of microphones 1024, 1026, a tele-coil 1028, a volume control potentiometer 1024, a memory-select toggle switch 1016, battery terminals 1018, 1022, and a speaker 1020.

Sound is received by the pair of microphones 1024, 1026, and converted into electrical signals that are coupled to the FMIC 1012C and RMIC 1012D inputs to the IC 1012A. FMIC refers to "front microphone," and RMIC refers to "rear microphone." The microphones 1024, 1026 are biased between a regulated voltage output from the RREG and FREG pins 1012B, and the ground nodes FGND 1012F, RGND 1012G. The regulated voltage output on FREG and RREG is generated internally to the IC 1012A by regulator 1030.

The tele-coil 1028 is a device used in a hearing aid that magnetically couples to a telephone handset and produces an input current that is proportional to the telephone signal. This input current from the tele-coil 1028 is coupled into the rear microphone A/D converter 1032B on the IC 1012A when the switch 1076 is connected to the "T" input pin 1012E, indicating that the user of the hearing aid is talking on a telephone. The tele-coil 1028 is used to prevent acoustic feedback into the system when talking on the telephone.

The volume control potentiometer 1014 is coupled to the volume control input 1012N of the IC. This variable resistor is used to set the volume sensitivity of the digital hearing aid.

The memory-select toggle switch 1016 is coupled between the positive voltage supply VB 1018 to the IC 1012A and the memory-select input pin 1012L. This switch 1016 is used to toggle the digital hearing aid system 1012 between a series of setup configurations. For example, the device may have been previously programmed for a variety of environmental settings, such as quiet listening, listening to music, a noisy setting, etc. For each of these settings, the system parameters of the IC 1012A may have been optimally configured for the particular user. By repeatedly pressing the toggle switch 1016, the user may then toggle through the various configurations stored in the read-only memory 1044 of the IC 1012A.

The battery terminals 1012K, 1012H of the IC 1012A are preferably coupled to a single 1.3 volt zinc-air battery. This battery provides the primary power source for the digital hearing aid system.

The last external component is the speaker 1020. This element is coupled to the differential outputs at pins 1012J, 1012I of the IC 1012A, and converts the processed digital input signals from the two microphones 1024, 1026 into an audible signal for the user of the digital hearing aid system 1012.

There are many circuit blocks within the IC 1012A. Primary sound processing within the system is carried out by the sound processor 1038. A pair of A/D converters 1032A, 1032B are coupled between the front and rear microphones 1024, 1026, and the sound processor 1038, and convert the analog input signals into the digital domain for digital processing by the sound processor 1038. A single D/A converter 1048 converts the processed digital signals back into the analog domain for output by the speaker 1020. Other system elements include a regulator 1030, a volume control A/D 1040, an interface/system controller 1042, an EEPROM memory 1044, a power-on reset circuit 1046, and a oscillator/system clock 1036.

The sound processor 1038 preferably includes a directional processor and headroom expander 1050, a pre-filter 1052, a wide-band twin detector 1054, a band-split filter 1056, a plurality of narrow-band channel processing and twin detectors 1058A-1058D, a summer 1060, a post filter 1062, a notch filter 1064, a volume control circuit 1066, an automatic gain control output circuit 1068, a peak clipping circuit 1070, a squelch circuit 1072, and a tone generator 1074.

Operationally, the sound processor 1038 processes digital sound as follows. Sound signals input to the front and rear microphones 1024, 1026 are coupled to the front and rear A/D converters 1032A, 1032B, which are preferably Sigma-Delta modulators followed by decimation filters that convert the analog sound inputs from the two microphones into a digital equivalent. Note that when a user of the digital hearing aid system is talking on the telephone, the rear A/D converter 1032B is coupled to the tele-coil input "T" 1012E via switch 1076. Both of the front and rear A/D converters 1032A, 1032B are clocked with the output clock signal from the oscillator/system clock 1036 (discussed in more detail below). This same output clock signal is also coupled to the sound processor 1038 and the D/A converter 1048.

The front and rear digital sound signals from the two A/D converters 1032A, 1032B are coupled to the directional processor and headroom expander 1050 of the sound processor 1038. The rear A/D converter 1032B is coupled to the processor 1050 through switch 1075. In a first position, the switch 1075 couples the digital output of the rear A/D converter 1032 B to the processor 1050, and in a second position, the switch 1075 couples the digital output of the rear A/D converter 1032B to summation block 1071 for the purpose of compensating for occlusion.

Occlusion is the amplification of the users own voice within the ear canal. The rear microphone can be moved inside the ear canal to receive this unwanted signal created by the occlusion effect. The occlusion effect is usually reduced in these types of systems by putting a mechanical vent in the hearing aid. This vent, however, can cause an oscillation problem as the speaker signal feeds back to the microphone(s) through the vent aperture. Another problem associated with traditional venting is a reduced low frequency response (leading to reduced sound quality). Yet another limitation occurs when the direct coupling of ambient sounds results in poor directional performance, particularly in the low frequencies. The system shown in FIG. 4 solves these problems by canceling the unwanted signal received by the rear microphone 1026 by feeding back the rear signal from the A/D converter 1032B to summation circuit 1071. The summation circuit 1071 then subtracts the unwanted signal from the processed composite signal to thereby compensate for the occlusion effect.

The directional processor and headroom expander 1050 includes a combination of filtering and delay elements that, when applied to the two digital input signals, forms a single, directionally-sensitive response. This directionally-sensitive response is generated such that the gain of the directional processor 1050 will be a maximum value for sounds coming from the front microphone 1024 and will be a minimum value for sounds coming from the rear microphone 1026.

The headroom expander portion of the processor 1050 significantly extends the dynamic range of the A/D conversion, which is very important for high fidelity audio signal processing. It does this by dynamically adjusting the A/D converters 1032A/1032B operating points. The headroom expander 1050 adjusts the gain before and after the A/D conversion so that the total gain remains unchanged, but the intrinsic dynamic range of the A/D converter block 1032A/1032B is optimized to the level of the signal being processed.

The output from the directional processor and headroom expander 1050 is coupled to a pre-filter 1052, which is a general-purpose filter for pre-conditioning the sound signal prior to any further signal processing steps. This "pre-conditioning" can take many forms, and, in combination with corresponding "post-conditioning" in the post filter 1062, can be used to generate special effects that may be suited to only a particular class of users. For example, the pre-filter 1052 could be configured to mimic the transfer function of the user's middle ear, effectively putting the sound signal into the "cochlear domain." Signal processing algorithms to correct a hearing impairment based on, for example, inner hair cell loss and outer hair cell loss, could be applied by the sound processor 1038. Subsequently, the post-filter 1062 could be configured with the inverse response of the pre-filter 1052 in order to convert the sound signal back into the "acoustic domain" from the "cochlear domain." Of course, other pre-conditioning/post-conditioning configurations and corresponding signal processing algorithms could be utilized.

The pre-conditioned digital sound signal is then coupled to the band-split filter 1056, which preferably includes a bank of filters with variable corner frequencies and pass-band gains. These filters are used to split the single input signal into four distinct frequency bands. The four output signals from the band-split filter 1056 are preferably in-phase so that when they are summed together in block 1060, after channel processing, nulls or peaks in the composite signal (from the summer) are minimized.

Channel processing of the four distinct frequency bands from the band-split filter 1056 is accomplished by a plurality of channel processing/twin detector blocks 1058A-1058D. Although four blocks are shown in FIG. 4, it should be clear that more than four (or less than four) frequency bands could be generated in the band-split filter 1056, and thus more or less than four channel processing/twin detector blocks 1058 may be utilized with the system.

Each of the channel processing/twin detectors 1058A-1058D provide an automatic gain control ("AGC") function that provides compression and gain on the particular frequency band (channel) being processed. Compression of the channel signals permits quieter sounds to be amplified at a higher gain than louder sounds, for which the gain is compressed. In this manner, the user of the system can hear the full range of sounds since the circuits 1058A-1058D compress the full range of normal hearing into the reduced dynamic range of the individual user as a function of the individual user's hearing loss within the particular frequency band of the channel.

The channel processing blocks 1058A-1058D can be configured to employ a twin detector average detection scheme while compressing the input signals. This twin detection scheme includes both slow and fast attack/release tracking modules that allow for fast response to transients (in the fast tracking module), while preventing annoying pumping of the input signal (in the slow tracking module) that only a fast time constant would produce. The outputs of the fast and slow tracking modules are compared, and the compression slope is then adjusted accordingly. The compression ratio, channel gain, lower and upper thresholds (return to linear point), and the fast and slow time constants (of the fast and slow tracking modules) can be independently programmed and saved in memory 1044 for each of the plurality of channel processing blocks 1058A-1058D.

FIG. 4 also shows a communication bus 1059, which may include one or more connections, for coupling the plurality of channel processing blocks 1058A-1058D. This inter-channel communication bus 1059 can be used to communicate information between the plurality of channel processing blocks 1058A-1058D such that each channel (frequency band) can take into account the "energy" level (or some other measure) from the other channel processing blocks. Preferably, each channel processing block 1058A-1058D would take into account the "energy" level from the higher frequency channels. In addition, the "energy" level from the wide-band detector 1054 may be used by each of the relatively narrow-band channel processing blocks 1058A-1058D when processing their individual input signals.

After channel processing is complete, the four channel signals are summed by summer 1060 to form a composite signal. This composite signal is then coupled to the post-filter 1062, which may apply a post-processing filter function as discussed above. Following post-processing, the composite signal is then applied to a notch-filter 1064, that attenuates a narrow band of frequencies that is adjustable in the frequency range where hearing aids tend to oscillate. This notch filter 1064 is used to reduce feedback and prevent unwanted "whistling" of the device. Preferably, the notch filter 1064 may include a dynamic transfer function that changes the depth of the notch based upon the magnitude of the input signal.

Following the notch filter 1064, the composite signal is then coupled to a volume control circuit 1066. The volume control circuit 1066 receives a digital value from the volume control A/D 1040, which indicates the desired volume level set by the user via potentiometer 1014, and uses this stored digital value to set the gain of an included amplifier circuit.

From the volume control circuit, the composite signal is then coupled to the AGC-output block 1068. The AGC-output circuit 1068 is a high compression ratio, low distortion limiter that is used to prevent pathological signals from causing large scale distorted output signals from the speaker 1020 that could be painful and annoying to the user of the device. The composite signal is coupled from the AGC-output circuit 1068 to a squelch circuit 1072, that performs an expansion on low-level signals below an adjustable threshold. The squelch circuit 1072 uses an output signal from the wide-band detector 1054 for this purpose. The expansion of the low-level signals attenuates noise from the microphones and other circuits when the input S/N ratio is small, thus producing a lower noise signal during quiet situations. Also shown coupled to the squelch circuit 1072 is a tone generator block 1074, which is included for calibration and testing of the system.

The output of the squelch circuit 1072 is coupled to one input of summer 1071. The other input to the summer 1071 is from the output of the rear A/D converter 1032B, when the switch 1075 is in the second position. These two signals are summed in summer 1071, and passed along to the interpolator and peak clipping circuit 1070. This circuit 1070 also operates on pathological signals, but it operates almost instantaneously to large peak signals and is high distortion limiting. The interpolator shifts the signal up in frequency as part of the D/A process and then the signal is clipped so that the distortion products do not alias back into the baseband frequency range.

The output of the interpolator and peak clipping circuit 1070 is coupled from the sound processor 1038 to the D/A H-Bridge 1048. This circuit 1048 converts the digital representation of the input sound signals to a pulse density modulated representation with complimentary outputs. These outputs are coupled off-chip through outputs 1012J, 1012I to the speaker 1020, which low-pass filters the outputs and produces an acoustic analog of the output signals. The D/A H-Bridge 1048 includes an interpolator, a digital Delta-Sigma modulator, and an H-Bridge output stage. The D/A H-Bridge 1048 is also coupled to and receives the clock signal from the oscillator/system clock 1036.

The interface/system controller 1042 is coupled between a serial data interface pin 1012M on the IC 1012, and the sound processor 1038. This interface is used to communicate with an external controller for the purpose of setting the parameters of the system. These parameters can be stored on-chip in the EEPROM 1044. If a "black-out" or "brown-out" condition occurs, then the power-on reset circuit 1046 can be used to signal the interface/system controller 1042 to configure the system into a known state. Such a condition can occur, for example, if the battery fails.

This written description uses examples to disclose the invention, including the best mode, and also to enable a person skilled in the art to make and use the invention. The patentable scope of the invention may include other examples that occur to those skilled in the art.

It is claimed:

1. A digital hearing instrument configured to be inserted into a patient's ear canal, comprising;

an outer microphone for receiving a first audio signal from outside of the patient's ear canal;

a sound processor for processing the first audio signal to compensate for a hearing instrument and generate a processed audio signal;

a hearing instrument receiver for converting the processed audio signal into an audio output signal to be directed into the patient's ear canal;

an inner microphone for receiving a second audio signal from inside of the patient's ear canal; and a serial data port for coupling the digital hearing instrument to an external device, the serial data port being configured to transmit the second audio signal to the external device.

2. The digital hearing instrument of claim 1 wherein the serial data port is further configured to communicate bi-directional audio signals between the hearing instrument and the external device.

3. The digital hearing instrument of claim 2, wherein the serial data port is further configured to transmit the first audio signal, the processed audio signal and the audio output signal to the external device.

4. The digital hearing instrument of claim 3, further comprising:

a selection circuitry configured to select at least one of the first audio signal, the second audio signal, the processed audio signal and the audio output signal for transmission to the external device via the serial data port.

5. The digital hearing instrument of claim 1, wherein the external device is used to monitor sound in the patient's ear canal to assess one or more performance characteristics of the digital hearing instrument.

6. The digital hearing instrument of claim 1 wherein the serial data port is further configured to transmit at least one other signal to the external device besides said second audio signal.

7. The digital hearing instrument of claim 6 further including selection circuitry configured to select between said second audio signal and said at least one other signal for transmission to the external device.

8. The digital hearing instrument of claim 7 wherein the at least one other signal is the first audio signal or the processed audio signal or the audio output signal.

9. The digital hearing instrument of claim 7 wherein the at least one other signal is the audio output signal.

10. A hearing instrument, comprising:

at least one hearing instrument microphone for receiving an audio input signal;

a sound processor for processing the audio input signal to compensate for a hearing impairment and generate a processed audio signal;

at least one hearing instrument receiver for converting the processed audio signal into an audio output signal;

a serial data port for coupling the hearing instrument to an external device separate from the hearing instrument, the serial data port being operable to transmit first and second digital audio signals between the hearing instrument and the external device, wherein said first digital audio signal is one said audio input signal, said processed audio signal, and said audio output signal, and wherein said second digital audio signal is another one of said audio input signal, said processed audio signal, and said audio output signal; and selection circuitry operable to select one of the first and second digital audio signals for transmission to the external device via the serial data port, wherein the hearing instrument is operable to receive a control signal for the selection circuitry, and the selection circuitry is further configured to select between said first and second digital audio signal based on the control signal.

11. The digital hearing instrument of claim 10 wherein said external device is one of a computer, a computer network, a monitoring device, and a recording device.

* * * * *

UNITED STATES PATENT AND TRADEMARK OFFICE

CERTIFICATE OF CORRECTION

PATENT NO. : 7,430,299 B2
APPLICATION NO. : 10/822519
DATED : September 30, 2008
INVENTOR(S) : Armstrong et al.

It is certified that error appears in the above-identified patent and that said Letters Patent is hereby corrected as shown below:

Column 12:
Claim 10, Line 14 Insert --of-- after "one"

Signed and Sealed this

Twenty-fifth Day of November, 2008

JON W. DUDAS
*Director of the United States Patent and Trademark Office*